US006104903A

United States Patent [19]

Hara et al.

[11] Patent Number: 6,104,903

[45] Date of Patent: Aug. 15, 2000

[54] DEVELOPING DEVICE

[75] Inventors: Nobuaki Hara, Numazu; Takao Honda, Mishima; Yoshito Mizoguchi, Kawasaki; Kazuo Suzuki, Yokohama, all of Japan

[73] Assignee: Canon Kabushiki Kaisha, Tokyo, Japan

[21] Appl. No.: 09/166,597

[22] Filed: Oct. 6, 1998

[30] Foreign Application Priority Data

Oct. 8, 1997 [JP] Japan ..... 9-291742
Oct. 8, 1997 [JP] Japan ..... 9-291743

[51] Int. Cl.[7] ..... G03G 15/08

[52] U.S. Cl. ..... 399/265; 399/286

[58] Field of Search ..... 399/265, 267, 399/272, 286

[56] References Cited

U.S. PATENT DOCUMENTS

| | | | |
|---|---|---|---|
| 4,526,130 | 7/1985 | Fukuda et al. | 118/657 |
| 4,600,294 | 7/1986 | Suzuki et al. | 355/14 D |
| 4,830,889 | 5/1989 | Henry et al. | 427/438 |
| 4,870,461 | 9/1989 | Watanabe et al. | 355/251 |
| 5,548,382 | 8/1996 | Koshi et al. | 399/176 |
| 5,621,505 | 4/1997 | Kobayashi et al. | 399/274 |
| 5,781,830 | 7/1998 | Gaylord et al. | 399/109 |

FOREIGN PATENT DOCUMENTS

| | | |
|---|---|---|
| 58-132768 | 8/1983 | Japan . |
| 3-41485 | 2/1991 | Japan . |
| 6-230676 | 8/1994 | Japan . |

*Primary Examiner*—William Royer
*Assistant Examiner*—Greg Moldatsky
*Attorney, Agent, or Firm*—Fitzpatrick, Cella, Harper & Scinto

[57] ABSTRACT

A developing device has a developing container containing a toner therein, and a toner carrying member provided in the opening portion of the developing container and rotatable with the toner carried thereon. The difference between the work function of the surface of the toner carrying member and the work function of the toner is greater than 0.1 and smaller than 1.0.

9 Claims, 7 Drawing Sheets

$$Ra = \frac{1}{L}\int_0^L |f(x)|\,dx \ (\mu m)$$

DEVELOPING DEVICE

BACKGROUND OF THE INVENTION

1. Field of the Invention

This invention relates to a developing device for developing an electrostatic image on an image bearing member such as a photosensitive member.

2. Related Background Art

In an image forming apparatus of the electrophotographic type, it has heretofore been practiced to form an electrostatic latent image on an image bearing member, and develop the latent image by a developing device. The developing device uses a developing sleeve of a non-magnetic metal containing therein a magnet roller for conveying a developer.

The surface of this developing sleeve is provided with suitable unevenness with a view to improve the conveyability and chargeability of the developer. A pipe of an inexpensive non-magnetic metal such as aluminum or an aluminum alloy is often used as the developing sleeve, but these are relatively soft metals (Vickers hardness Hv=70 to 120) and therefore, have the disadvantage that when the developing sleeve is used for a long period of time, the unevenness of the surface thereof is decreased or the uneven state is changed by the abrasion by the developer and images of good quality which have been obtained at the initial stage of use become unobtainable.

Describing this in detail with reference to the accompanying drawings, FIG. 7 is a cross-sectional view showing a developing sleeve heretofore used. The developing sleeve 6 is formed of aluminum which is a non-magnetic metal, and a magnet roller 7 as magnetic field producing means is contained in it. This developing sleeve 6 is disposed in a developing device for rotation about the magnet roller 7, while on the other hand, the magnet roller 7 is disposed against rotation.

FIG. 8 is a cross-sectional view of the surface portion of the developing sleeve 6, and unevenness 11 is provided on the surface of the developing sleeve 6 by blast treatment using glass beads. As regards the surface of the developing sleeve 6 having such unevenness 11, even though the surface roughness thereof is Rz=about 4.0 $\mu$m at the early stage of use, it decreases to Rz=about 3.0 $\mu$m after the development of about 10,000 sheets. As the result, the conveyability and chargeability of the developer are reduced to a level lower than the initially set level, and the image density obtained is reduced.

As a countermeasure for such a problem, it has been proposed to form a hard metal layer 12 of Cr or Cu, Ni and Cr or the like having hardness Hv=450 or so on the uneven surface of the developing sleeve 6, as shown in FIG. 9 (Japanese Laid-Open Patent Application No. 3-41485).

Such a developing sleeve as is provided with metal plating is high in the smoothness of the surface thereof and cannot sufficiently charge the developer or produces an irregular coat of the toner.

This problem will become more remarkable particularly if a magnetic positive toner (one-component positive magnetic developer) is used for development in a reverse developing system using an amorphous silicon drum as a photosensitive drum (image bearing member).

That is, the photosensitive drum of amorphous silicon is excellent in durability but low in charging ability, as compared with an OPC drum heretofore frequently used. Even if the surface of the drum is charged by suitable charging means to form an electrostatic latent image on the photosensitive drum, it is charged only to the order of +400 V to +450 V. Therefore, the latent image potential becomes shallow and the image density becomes low and thus, if the DC component of developing bias is set to a rather high level, toner charged to the positive also adheres to white portions on the photosensitive drum which are not latent image portions, and a so-called fogged image is remarkably created and the quality of image is reduced. So, if a toner enriched in magnetism is used to reduce the fogged image, there cannot be obtained a charging amount necessary to secure sufficient density, as described at the outset.

SUMMARY OF THE INVENTION

It is an object of the present invention to provide a developing device which can sufficiently charge a toner even if the smoothness of the surface thereof is high.

It is another object of the present invention to provide a developing device which can uniformly coat a toner carrying member with a toner.

It is still another object of the present invention to provide a developing device comprising:

a developing container for containing a toner therein; and a toner bearing member provided in an opening portion of said developing container for bearing the toner to rotate;

the difference between the work function of the surface of said toner carrying member and the work function of the toner being greater than 0.1 and smaller than 1.0.

It is yet still another object of the present invention to provide a developing device having:

a developing container containing a toner therein; and a toner bearing member provided in an opening portion of said developing container for bearing the toner to rotate;

said toner bearing member satisfying the following conditions:

$Ra-13|\Delta W| \leqq -0.6$ $Ra-6|\Delta W| \geqq -6$ $19Ra-|\Delta W| \geqq 0.9$ $Ra \leqq 0.7$, where Ra is center line average roughness ($\mu$m) of the surface of the toner bearing member $\Delta W$ is the difference (eV) between a work function of the surface of the toner bearing member and a work function of the toner.

Further, objects of the present invention will become apparent from the following description.

DESCRIPTION OF THE PREFERRED EMBODIMENTS

Some embodiments of the present invention will hereinafter be described.

Figure 1:
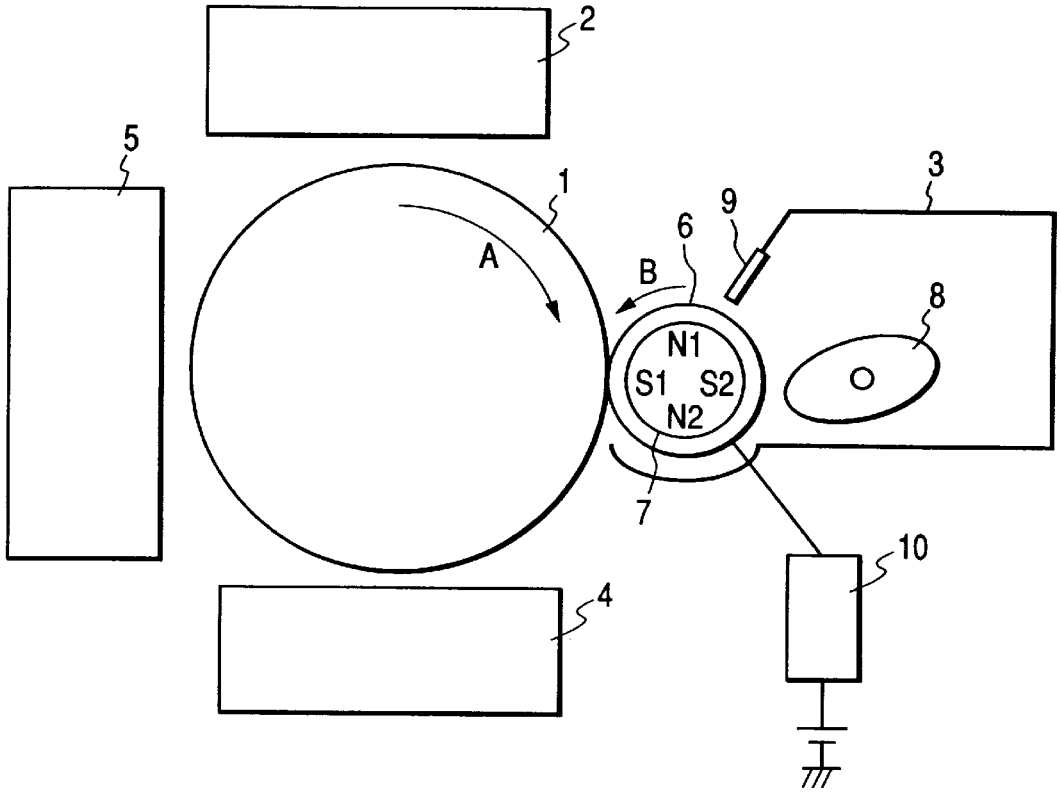
FIG. 1 schematically shows the construction of an embodiment of the image forming apparatus of the present invention.

FIG. 1 schematically shows the construction of an embodiment of the image forming apparatus of the present invention. In FIG. 1, the reference numeral 1 designates an image bearing member which, in the present embodiment, is an electrophotographic photosensitive drum. Around this photosensitive drum 1, there are provided a latent image forming portion 2 for forming an electrostatic latent image on the surface of the photosensitive drum 1, a developing device 3 for developing the latent image, a transfer separating portion 4 for transferring a toner image obtained by development to a transfer material and also separating the transfer material from the photosensitive drum 1, and a cleaning portion for removing any untransferred toner remaining on the photosensitive drum 1.

To form an image, the photosensitive drum 1 is rotated in the direction of arrow A, and the surface of the photosensitive drum 1 is first charged by the latent image forming portion 2, and image exposure is effected to thereby form an electrostatic latent image. The latent image formed on the photosensitive drum 1 is moved to the position of the developing device 3 with the rotation of the photosensitive drum 1, and is developed by the developing device 3 by the use of the magnetic toner of a one-component developer.

According to the present embodiment, the developing device 3 contains a magnetic toner of positive chargeability therein. The developing device 3 is comprised of a developing sleeve 6 carrying this magnetic toner thereon and rotated in the direction of arrow B to thereby convey the toner to a developing portion opposed to the photosensitive drum 1, a magnet roller 7 as magnetic field producing means disposed in the developing sleeve 6 against rotation, agitating means 8 for agitating the toner in the developing device 3 to thereby enhance the fluidity of the toner and also conveying the toner to the developing sleeve 6, a magnetic blade 9 for regulating the layer thickness of the toner carried on the developing sleeve 6, and a bias voltage source 10 for applying a developing bias to the developing sleeve 6. The developing sleeve 6 is disposed in opposed relationship with the photosensitive drum 1 with a predetermined minimum gap therebetween. The magnet roller 7 has four magnetic poles N1, S1, N2 and S2.

The magnetic blade 9 is disposed in opposed relationship with the magnetic pole N1 of the magnet roller 7 in the developing sleeve 6 with a predetermined gap therebetween, and regulates the layer thickness of the toner carried on the developing sleeve 6 by a magnetic field formed between the magnetic blade 9 and the magnetic pole N1 (regulating pole). The toner conveyed to the developing portion after having had its layer thickness regulated is erected on the surface of the developing sleeve 6 by the magnetic pole S1 (developing pole) of the magnet roller 7 disposed in the developing portion. The erected toner flies and adheres to the latent image portion due to the potential difference between the latent image on the photosensitive drum 1 and the developing sleeve 6, and the latent image is developed as a toner image.

In order to expedite development at this time, a developing bias comprising an AC voltage superposed on a DC voltage is applied to the developing sleeve 6 between it and the photosensitive drum 1 by the bias voltage source 10. The toner on the developing sleeve 6 flies by the developing bias and repeats the adherence to and separation from the photosensitive drum 1. Until the latent image portion of the surface of the photosensitive drum 1 separates from the developing portion, the toner corresponding to the potential of the latent image adheres to and remains on the latent image portion and thus, the latent image is well developed.

The toner image formed on the photosensitive drum 1 in this manner is transferred to a transfer material, not shown, supplied to the photosensitive drum 1 at the transfer separating portion 4. The transfer material is separated from the photosensitive drum 1 while the toner image is transferred thereto from the photosensitive drum 1 by the transfer separating portion 4, whereafter it is conveyed to a fixating portion by conveying means, not shown, and the fixation of the toner image to the transfer material is effected there. After the transfer has been done, the photosensitive drum 1 has any untransferred toner remaining an its surface removed by the cleaning portion 5 and becomes ready for the formation of the next latent image.

An example of the various numerical data of the apparatus in the present embodiment is shown below.

The magnetic forces of the magnetic poles of the magnet roller (on the surface of the developing sleeve:
N1=850 gauss, S1=950 gauss,
N2=750 gauss, S2=550 gauss The shortest distance between the photosensitive drum and the developing sleeve: 230 $\mu$m The distance between the developing sleeve and the magnetic blade: 240 $\mu$m Developing bias: DC voltage+AC voltage. DC voltage=+250 V, AC voltage=peak-to-peak voltage 1.4 kV,
frequency 2.7 kHz Photosensitive drum: a-Si, dark portion potential=+400 V, light portion potential=+50 V Image forming speed: A4 size 40 sheets/min.

In the present invention, the material of the sleeve base used for the developing sleeve 6 is not particularly limited if it is a non-magnetic metal. However, a relatively soft non-magnetic metallic material of Vickers hardness Hv=70 to 10 such as an aluminum alloy or a copper alloy is suitable for displaying the effect of the present invention, and is particularly preferable as the material of the sleeve base.

The use of a developing sleeve made of aluminum is seen in a high-speed and highly durable image forming apparatus using an amorphous silicon (a-Si) drum as an image bearing member. In the high-speed and highly durable image forming apparatus, a corotron or scorotron charging method is often used for the charging of the photosensitive drum because it is high in charging efficiency. However, if a discharge product is produced in the charging process and it adheres to the surface of the photosensitive drum, the potential of the portion to which the discharge product has adhered will change and irregularity will occur to an image obtained.

So, it is necessary to heat and control the photo-sensitive drum to 40° C. so that the discharge product may not adhere to the surface of the photosensitive drum. Regarding the heating and temperature control, the thermal deformation of the developing sleeve is feared, but the aluminum base is small in thermal deformation and can be used without any problem even if the temperature control to 40° C. is effected.

According to a simulation calculation, in the case of a condition under which the diameter of the developing sleeve is 24.5 mm and the gap between the developing sleeve and the photosensitive drum is about 240 μm, the amount of flexure of the developing sleeve was 25 μm when the material of the developing sleeve was SuS, whereas it was of the order of 5 μm when the material of the developing sleeve was aluminum. When the gap between the developing sleeve and the photosensitive drum is 240 μm, it is confirmed that if the amount of flexure of the developing sleeve exceeds 20 μm, the density irregularity of the image becomes remarkable.

As described above, in the high-speed and highly durable image forming apparatus using an a-Si drum, the image irregularity can be made small and the life of the developing sleeve can be lengthened if as in the present invention, the developing sleeve is made of aluminum which is small in thermal deformation and a plating layer is provided on the surface of the developing sleeve to thereby increase the hardness thereof. Of course, according to the present invention, durability is also improved in stainless steel of hardness Hv=150 to 190 which is a high-class material used when a long life is required of the developing sleeve.

In the present invention, in order to improve the conveyability of the toner by the developing sleeve 6, the surface of the developing sleeve is preferably roughened. The roughening of the surface of the developing sleeve can be done by various methods, but in the present invention, it was done by sand blast treatment as will be described below.

As abrasive grains which are a blast material, use is made of abrasive grains of a regular shape (spherical or flat particles having smooth surfaces are good), or preferably glass beads of a grain size of #100 to #600. A blast nozzle is positioned at a distance of 7 mm from the developing sleeve, and the developing sleeve is rotated at 12 rpm, and the glass beads are blown at air pressure of 3 kg/m$^2$ from the nozzle. During this blowing, the nozzle is moved by a distance of 30 cm in one to two minutes in parallel with the axis of the developing sleeve along the surface thereof. In this manner, the surface of the developing sleeve is blast-treated to thereby obtain a rough surface. After the blast treatment, the developing sleeve has its surface washed, and thereafter is dried.

In the present embodiment, the developing sleeve made of aluminum containing a magnet roller therein was subjected to sand blast treatment by the use of glass beads of #300 and the surface thereof was roughened. At this time, the air pressure under which the glass beads were blown was variously changed to thereby change of the surface roughness Ra of the developing sleeve variously. These developing sleeves were used in the developing device 3 of FIG. 1 and the conveying properties of the developing sleeves for the magnetic toner of positive chargeability contained in the developing device 3 were examined. The result is shown in FIG. 2.

Figure 2:
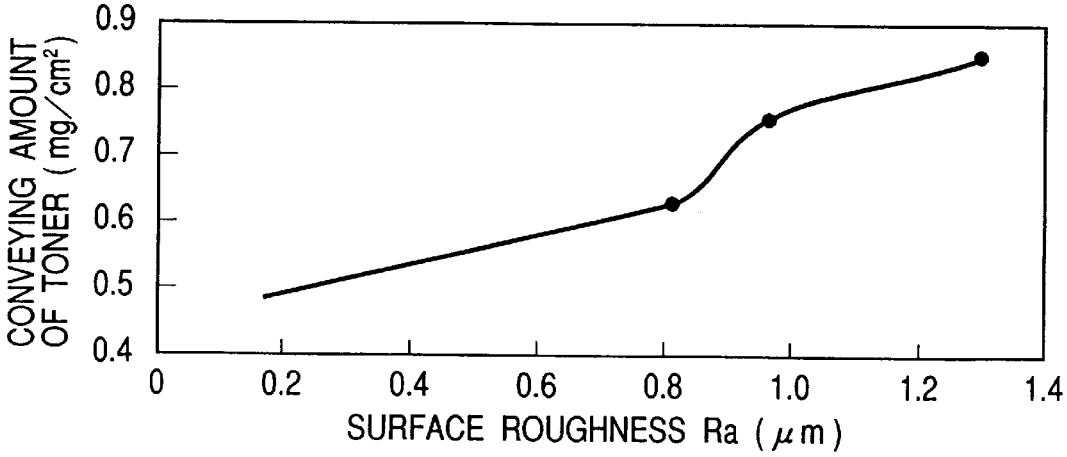
FIG. 2 is a graph showing the relation between the surface roughness of the developing sleeve of a developing device and the convey ability of a magnetic toner.

As shown in FIG. 2, the toner conveying property of the developing sleeve is substantially determined by the degree of the surface roughness, and the greater becomes the surface roughness, the greater becomes the amount of conveyance. In the present invention, as will be described later, the plating of a non-magnetic metal is provided on the roughened surface of the developing sleeve, and if the thickness of this plating is small and uniform, the surface roughness of the developing sleeve will not substantially be changed and the toner conveying property thereof will not be affected.

Also, these developing sleeves were incorporated into the developing device 3 and was used for development, and image formation was effected by the image forming apparatus of FIG. 1.

The density of print images obtained and the state of the coating irregularity of the toner onto the developing sleeve were examined. The result is shown in Table 1 below.

In Table 1, as regards the mark in the columns of image density, ○ shows that the maximum density at the early stage of development is not less than 1.3, Δ shows that it is not less than 1.2 and less than 1.3, and x shows that it is less than 1.2. As regards the marks in the columns of coating irregularity, ○ shows that no coating irregularity of the toner is seen on the developing sleeve, Δ shows that some coating irregularity is seen but gives no problem to images, and x means that coating irregularity appears as image irregularity.

TABLE 1

| Ra (μm) | 0.2 | 0.4 | 0.6 | 0.8 | 1.0 | 1.2 | 1.4 | 1.6 | 1.8 |
|---|---|---|---|---|---|---|---|---|---|
| density | x | x | Δ | ○ | ○ | ○ | ○ | ○ | ○ |
| coating irregularity | ○ | ○ | ○ | ○ | ○ | ○ | Δ | x | x |

The proper amount of conveyed toner on the developing sleeve differs depending on the operating speed (process speed) of the image forming apparatus, but it is known that relatively good image density is obtained for an amount of conveyance greater than 0.6 mg/cm$^2$, and for that purpose, it is seen from FIG. 2 that 0.6 μm or greater is preferable as the value of the surface roughness Ra of the developing sleeve. Also, it is seen from Table 1 that if the surface roughness Ra exceeds 1.4, coating irregularity occurs and the toner coating the developing sleeve does not become uniform. Accordingly, in the present invention, the surface roughness Ra (the center line average roughness) of the roughened developing sleeve 1 is 0.6 to 1.4 μm, and preferably the surface roughness Ra after plating is Ra=0.6 to 1.4 μm.

In the present invention, in order to heighten the hardness of the surface of the developing sleeve, as described above, non-magnetic metal plating is provided on the surface of the developing sleeve after the surface of the developing sleeve is roughened. While there are various kinds of plating treatment for the hardening of the surface, not electroplating but electroless plating is used in the present invention.

As the electroless plating of non-magnetic metals, for example, electroless Ni—P plating, electroless Ni—B plating and electroless Cr plating are suitable.

As described above, the developing sleeve 6 is non-magnetic because a magnetic toner is used. The metal plating provided on the surface of the developing sleeve is usable even if it has magnetism because the plating layer thickness thereof is as small as several μm, but preferably it is non-magnetic. Nickel (Ni) is a ferromagnetic material, but in an electroless Ni—P or Ni—B plating layer, nickel becomes amorphous and non-magnetic by being united with phosphor (P) or boron (B). The phosphor content in Ni—P plating film required for such non-magnetism is B to 10 wt %, and the boron content in Ni—B plating film is 5 to 7 wt %.

Plating may be uniformly provided on the entire surface of the developing sleeve 6, but can be made into a mesh-like shape having arbitrary openings for the adjustment of a work function which will be described later. By effecting plating after mesh-like masking treatment has been done, mesh-like plating is obtained. Also, as is often done to enhance the close contacting property between the plating film and the surface of the developing sleeve, zincate treatment for producing zinc alloy film on the surface of the developing sleeve can be effected before plating is done.

The reason why not electroplating but electroless plating is used in the present invention is that a precipitated plating metal can be attached to a uniform thickness on the roughened uneven surface of the developing sleeve 6 without being affected by the unevenness and plating film of a uniform thickness can be obtained. Accordingly, the surface roughness obtained by roughening can be maintained almost without being changed. In electroplating, it is difficult for a plating metal to be precipitated on the recesses of the roughened surface of the developing sleeve and the metal adheres preferentially to the convex portions and only the convex portions are thickly plated and therefore, plating film of a uniform thickness is not obtained and the surface roughness changes.

In the present invention, the thickness of the plating layer of the non-magnetic metal provided on the surface of the developing sleeve 6 is 3 to 20 μm. Description will hereinafter be made on the basis of an experiment carried out by the inventors.

When a developing sleeve of stainless steel (SUS 316) was sand-blast-treated with glass beads of #300 on the surface thereof, was used for development without being subjected to metal plating and continuous image formation was repetitively effected by the use of a toner of a small particle diameter (6 μm) which can improve imaging property, the following phenomena occurred.

(1) When the number of prints reached 2000 to 5000 sheets, image density was reduced from 1.3 to 1.0. (2) When at the point of time whereat the above-mentioned image density was reduced, the original was changed to a solid black surface and image formation was done, the printed image became a partly white image having a low density portion corresponding to the rotation period of the developing sleeve. (3) When the toner on the developing sleeve at the point of time whereat the image density was reduced was removed and the developing sleeve was washed with a solvent and then was used again for development, the image density was recovered.

So, when the frictionally charged amount of the toner at the point of time of item (1) above whereat the image density was reduced was measured, it has been found that it is ½ or less of the charged amount of the toner at the start of image formation and the reduction in the charged amount of the toner is the cause of the reduction in the image density. Likewise, when the creation of the partly white image of item (2) above was examined, the cause of the white portion was also the reduction in the charged amount of the toner. However, the recovery of the image density by the removal of the toner and the washing of the developing sleeve mentioned under item (3) above makes us infer that its cause is not the deterioration of the toner including the reduction in the charged amount, but a change in the properties of the surface of the developing sleeve.

Figure 3:
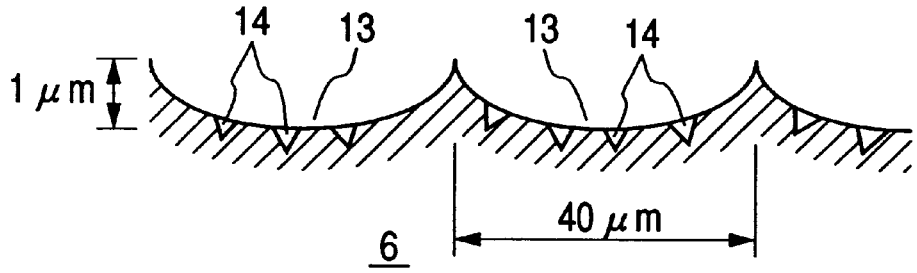
FIG. 3 is a cross-sectional view typically showing the surface of the developing sleeve when the developing sleeve as it is subjected to sand blast treatment is repetitively used for continuous image formation.

In order to confirm the change in the properties of the surface of the developing sleeve, the surface of the developing sleeve was observed through an electronic microscope at the above-mentioned time whereat the image density was reduced. Thereupon, as typically shown in FIG. 3, it has been found that there are a plurality of small depressions 14 having a diameter of the order of 5 μm in particularly the recesses 13 of the uneven portion of the surface, and more particularly the recess 13 having a diameter of the order of 40 μm and a depth of the order of 1 μm, and something is embedded in these depressions 14. When this substance was collected and analyzed, it was the debris of binder resin which was the main component of the toner.

When the debris of the resin of the toner are thus present on the surface of the developing sleeve, the resin of the toner contacting with the surface of the developing sleeve often contacts with the resin on the surface of the developing sleeve and therefore, sufficient frictionally charging charges are not given to the toner and the charged amount of the toner is reduced.

When plating of a thickness of 3 μm or greater is provided on the surface of the developing sleeve, the small depressions 14 of a diameter of the order of 5 μm in which the resin of the toner is embedded can be filled with the plating metal. Therefore, the presence of the debri of the resin of the toner on the surface of the developing sleeve can be eliminated during continuous image formation and the toner can be charged well by the surface of the developing sleeve, and the occurrence of the reduction in the charged amount can be prevented.

The upper limit of the thickness of the plating is 20 μm, and if the plating is made thicker than this, uniform plating film is not obtained on the surface of the developing sleeve, and great unevenness necessary for the conveyance of the toner is filled and the conveyability of the toner is reduced, and this is not preferable.

The effect of the eliminating the small depressions 14 in the recesses 13 of the surface of the developing sleeve by the above-mentioned embedding of the plating metal is particularly useful in the case of a developing sleeve using SUS of which the hardness is as relatively high as Hv=150 to 190. This is because even if the sand blast treatment by particles of a regular shape is effected, when the hardness of the material of the developing sleeve is high, the surface of the developing sleeve cannot be smoothly blasted as per the configuration of the particles and not a few small depressions in which the resin of the toner is embedded are created in the surface of the developing sleeve.

The hardness of the metal plating may preferably be Hv=450 or greater, and necessary wear resistance can be obtained. The higher is the upper limit of the hardness, the better, but if annealing which is usually used means for increasing the hardness of plating is done, the developing sleeve will become warped and the vibration during the rotation thereof will become great and therefore, in practice, the upper limit is of the order of Hv=1000.

As described above, in the present invention, the surface of the developing sleeve 6 is roughened and further, is subjected to the plating of a non-magnetic metal to thereby make a developing sleeve of surface roughness Ra=0.6 to 1.4 μm having a plating layer of a non-magnetic metal having a thickness of 3 to 20 μm. However, depending on the kind of the combination of the plating metal and the magnetic toner, there may occur a circumstance in which the toner cannot be sufficiently charged on the surface of the developing sleeve.

Toners A and B (produced by Canon Inc.) were prepared as magnetic toners of positive chargeability (one-component magnetic developers) and were contained in the developing device 3 for use for development, and image formation was effected. As the developing sleeve 6, one provided with electroless Ni—P plating was used. The result of the measurement of the amounts of charge of the toners at that time is shown in Table 2 below.

TABLE 2

| | toner A | toner B |
|---|---|---|
| amount of charge ($\mu$C/g) | 11.1 | 1.9 |

As shown in Table 2, the combination of the toner A and the developing sleeve provided with electroless Ni—P plating suffers from no problem, but in the combination of the toner B and the developing sleeve provided with electroless Ni—P plating, the charged amount of the toner B was very small and sufficient image density and image quality could not be obtained. Generally, to obtain sufficient image density and image quality, it is necessary that the charged amount of toner be of the order of 6.0 $\mu$C/g or greater. The amount of conveyed toner on the developing sleeve is also related to image density and image quality, but for both of the toners A and B, 0.70 g/cm$^2$ or greater was obtained and the amount of conveyed toner was sufficient.

In order to examine the cause of the difference between the charged amounts of the toners A and B, the work functions W.F of the toners A and B and the metal plating such as electroless Ni—P plating were examined by the use of a work function measuring apparatus utilizing a photoelectric effect (surface analyzing apparatus AC-1S produced by Riken Keiki Co., Ltd.). The work functions of the toners were measured with each toner melted into a plate-like shape on an aluminum plate. The result is shown in Table 3 below.

TABLE 3

| | work function (eV) |
|---|---|
| toner A | 4.1 |
| toner B | 4.5 |
| Cr electroplating | 4.0 |
| electroless Ni-P plating | 4.4 |
| electroless Ni-B plating | 4.5 |
| electroless Cr plating | 4.7 |
| Cu electroplating | 5.4 |

Generally, when two substances are brought into contact with each other, a substance having a smaller work function tends to be charged to the positive and accordingly, when a toner charged to the positive is used, it is necessary that a plating agent provided on the surface of the developing sleeve be greater in work function than the toner.

Figure 4:
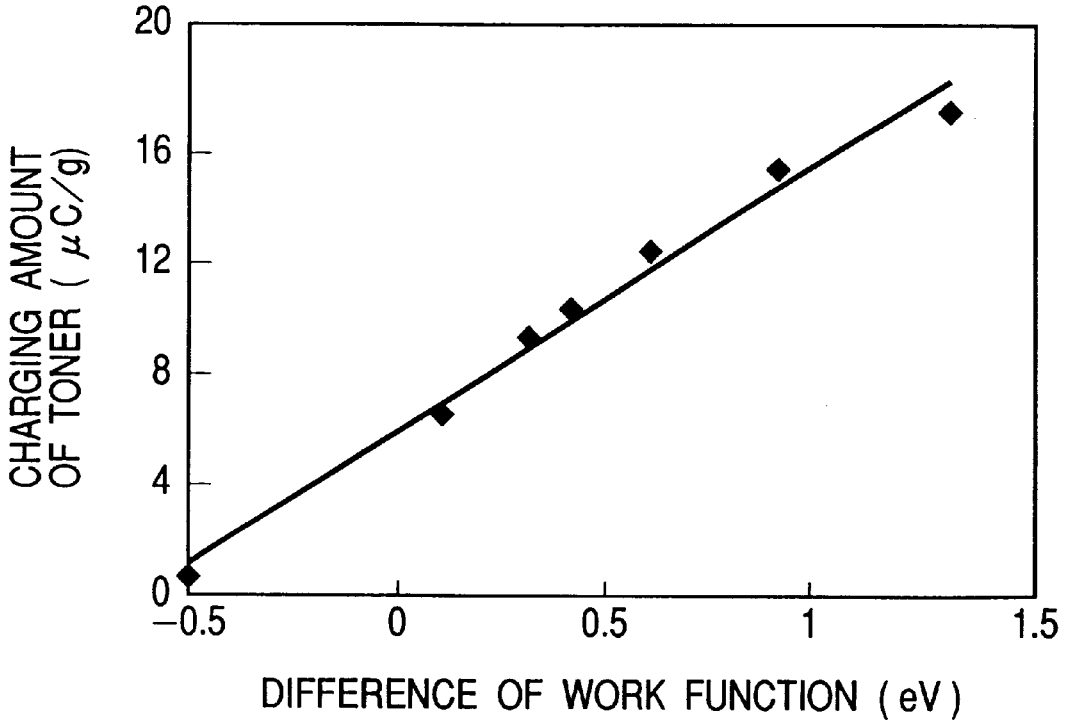
FIG. 4 is a graph showing the relation between the difference in the work function between the plating layer of a non-magnetic metal on the surface of the developing sleeve and the magnetic toner and the charged amount of toner.

Table 4 below shows the charged amounts of the toners obtained when the combinations of the kinds of the plating provided on the surface of the developing sleeve and the toners were changed, and the image densities and the state of the toner coating irregularity on the developing sleeve when development was effected to thereby form images with the developing sleeves subjected to these kinds of plating and the toners A and b combined together. The developing sleeve used had surface roughness Ra=1.1 $\mu$m. Also, FIG. 4 shows a graph in which the difference of work function is plotted as the axis of abscissas and the charged amount of toner is plotted as the axis of ordinates.

TABLE 4

| kind of toner | B | A | A | A | B | B | A |
|---|---|---|---|---|---|---|---|
| kind of plating | electro Cr | electro Cr | electro less Ni—P | electro-less Ni—B | electro-less Cr | electro Cu | electro Cu |
| difference of work function (eV) | −0.5 | 0.1 | 0.3 | 0.4 | 0.6 | 0.9 | 1.3 |
| charged amount of toner ($\mu$C/g) | 0.7 | 6.6 | 9.0 | 10.0 | 12.0 | 15.0 | 17.0 |
| density | x | Δ | ○ | ○ | ○ | ○ | ○ |
| unevenness of coating | ○ | ○ | ○ | ○ | ○ | Δ | x |

In Table 4, as regards the marks in the columns of density, ○ shows that at the early stage of development, the maximum density is 1.3 or greater, Δ shows that the maximum density is not less than 1.2 and less than 1.3, and x shows that the maximum density is less than 1.2. As regards the marks in the columns of coating irregularity, ○ shows that no coating irregularity of the toner is seen on the developing sleeve, Δ shows that some coating irregularity of the toner is seen on the developing sleeve, but gives no problem to images, and x shows that coating irregularity appears as image irregularity. The amount of conveyed toner on the developing sleeve was nearly 0.8 g/cm$^2$ in the case of any combination.

Generally, to obtain sufficient image density, it is said that the charged amount of the toner of at least 6 $\mu$C/g or so is necessary, but if this exceeds 15 $\mu$C/g, a portion of the developing sleeve will be concentratedly coated with the toner. Also in the present experiment, when electroplating of copper as the plating agent was effected, the charged amount of the toner became 17 $\mu$C/g and the coating irregularity of the toner was confirmed.

From such a fact, it is considered that for the combination of the metal plating layer and the toner, the difference of work function is appropriately between 0.1 and 1.0. That is, 0.1 eV≦(work function of the plating layer—work function of the toner)≦1.0 eV.

The foregoing is a case where the charging of the toner is of the positive polarity, but when the charging of the toner is of the negative polarity, the positive and negative signs of the numerical values can be replaced with each other as follows.

−1.0 eV≦(work function of the plating layer—work function of the toner)≦−0.1 eV.

If this is generalized so as to be applicable to a toner having a positive charging polarity and a toner having a negative charging polarity, by the use of the absolute value of the difference of work function, 0.1 eV≦| work function of the plating layer−work function of the toner|≦1.0 eV.

Description will hereinafter be made of the magnetic toner used in the present invention.

The grain diameter of the magnetic toner is 4 to 9 $\mu$m as the volume average grain diameter, and preferably 4 to 8 $\mu$m. If the volume average grain diameter of the toner is 4 $\mu$m or less, when the toner is used for a use such as a graphic image in which the image area percentage is high, the problem that a little of the toner is transferred onto a transfer material and the image density becomes low is liable to arise. This is considered to be for the same reason as when in contrast with the edge portion of a latent image, the density of the inner portion thereof is lowered. If the volume average grain diameter of the toner is 9 μm or larger, the resolution is not good, and even if it is good at the early stage of image formation, the deterioration of image quality if liable to occur as the toner continues to be used.

The grain size distribution of the toner can be measured by various methods, and in the present invention, the measurement was done by the use of a coal tar counter TA-II (produced by Coal Tar Inc.). A personal computer CX-i (produced by Canon Inc.) which outputs the number distribution and volume distribution of the toner was connected to the coal tar counter. As the electrolyte, first class sodium chloride was used to prepare 1% NaCl water solution.

0.1 to 5 ml of interfacial active agent, preferably alkyl benzene sulphonate, as a dispersing agent was added to 100 to 150 ml of electrolyte, and 2 to 20 mg of magnetic toner as a measurement sample was further added. The electrolyte in which this measurement sample was suspended was subjected to dispersion treatment for about one to three minutes by an ultrasonic disperser, and by the above-mentioned coal tar counter and by the use of an aperture of 100 μ, the grain size distribution of toner particles of 2 to 40 μm was measured with the number as the reference, and then the volume grain size distribution was found.

The true density of the magnetic toner is preferably 1.45 to 1.70 g/cm$^3$, and more preferably 1.50 to 1.65 g/cm$^3$. If the true density of the magnetic toner is smaller than 1.45, the weight of a magnetic toner particle itself is too light and the batter of thin lines, scattering and the aggravation of resolving power due to reverse fog and excessive transfer of toner particles become liable to be caused. If the true density of the magnetic toner is greater than 1.70, there will be provided an image in which the image density is thin and which lacks sharpness such as suffering from the breaks of thin lines. Also, the magnetic force of the toner becomes relatively great and therefore, the ears of the toner particles become long or bifurcated, and the resultant image is liable to become disturbed by development and coarse in quality.

There are several methods of measuring the true density of the magnetic toner, and in the present invention, there was adopted the following method capable of accurately and simply measuring the true density of fine powder.

A cylinder made of stainless steel and having an inner diameter of 10 mm and a length of about 5 cm, a disc (A) capable of being closely fitted thereinto and having an outer diameter of about 10 mm and a height of 5 mm, and a piston (B) having an outer diameter of about 10 mm and a length of about 8 cm are prepared. The disc (A) is put into the bottom of the cylinder, and then about 1g of magnetic toner which is a measurement sample is put thereinto, and thereafter the piston (B) is quietly pushed in. A force of 400 kg/cm$^2$ is applied to the piston (B) by a hydraulic press to thereby compress the toner, and this compressed state is maintained for five minutes, and then the toner is taken out.

The weight W(g) of this compressed sample is measured, and the diameter D(cm) and height L(cm) of the compressed sample are measured by a micrometer, and from the expression that true density (g/cm$^3$)$=w/\{\pi\times(D/2)^2\times L\}$, the true density of the magnetic toner is calculated.

To obtain a better developing property by the magnetic toner, it is preferable that the magnetic toner have residual magnetization or of 1 to 5 emu/g, preferably 2 to 4.5 emu/g, and saturation magnetization σs of 20 to 40 emu/g, and a high magnetic force Hc have a magnetic characteristic of 40 to 100 oersted (Oe).

In the present invention, as the binding resin of the toner, use can be made of the following resin when the use of a heating pressing roller fixating device for effecting the application of oil is taken into consideration:

styrene such as polystyrene, poly-p-chlorostyrene or polyvinyl toluene and monopolymer of the substitution product thereof; styrene copolymer such as styrene-p-chlorostyrene copolymer, styrene-vinyl toluene copolymer, styrene-vinyl naphthalene copolymer, styrene-acrylic acid ester copolymer, styrene-methacrylic acid ester copolymer, styrene-α-chloromethacrylic acid methyl copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer or styrene-acrylonitrile-indene copolymer; polyvinyl chloride, phenol resin, natural denatured phenol resin, natural resin denatured maleic resin, acrylic resin, methacrylic resin, polyvinyl acetate, silicone resin, polyester resin, polyurethane, polyamide resin, fran resin, epoxy resin, xylene resin, polyvinyl butyral, terpene resin, coumarone-indene resin, petroleum resin or the like.

In the heating pressing roller fixating device of a type which hardly applies oil, the so-called offset phenomenon in which a portion of a toner image on a transfer material shifts to a roller, and the closely contacting property of the toner with respect to the transfer material are important matters. The toner which is fixated with less heat energy has the property of being liable to block or cake usually during preservation or in the developing device and therefore, these problems must be taken into consideration at the same time.

The physical properties of the binding resin of the toner are most greatly concerned in these problems. According to the inventors' researches, when the content of a magnetic material in the toner is decreased, the closely contacting property with respect to the transfer material becomes good during fixation, but offset becomes liable to occur and blocking or caking also becomes liable to occur.

Therefore, when use is made of the heating pressing roller fixating device of the type which hardly applies oil, the selection of the binding resin of the toner is important, and as preferable binding resin, use is made of bridges styrene copolymer or bridges polyester.

As comonomer to the styrene monomer of this styrene copolymer, use can be made of monocarboxylic acid having double bond or the substitution product thereof, such as acrylic acid, methyl acrylate, ethyl acrylate, butyl acrylate, dodecyl acrylate, octyl acrylate, acrylic acid-2-ethyl hexyl, phenyl acrylate, methyl methacrylate, ethyl methacrylate, butyl methacrylate, octyl methacrylate, acrylonitrile, methacrynitrile or acrylic amide; dicarboxylic acid having double bond and the substitution product thereof, such as maleic acid, butyl maleate, methyl maleate or dimethyl maleate; vinyl ester such as vinyl chloride, vinyl acetate or benzoic vinyl; ethylene olefin such as ethylene, propylene or butylene; vinyl ketone such as vinyl methyl ketone or vinyl hexyl ketone; one or more vinyl monomers of vinyl ether such as vinyl methyl ether, vinyl ethyl ether or vinyl isobutyl ether.

As a bridging agent, use is made of chiefly a polymerizable compound having two or more double bonds. For example, an aromatic dinyl compound such as divinyl benzene or divinyl naphthalene; ester carboxylate having two double bonds such as ethylene glycol diacrylate, ethylene glycol dimethacrylate or 1, 3-butanediol acrylate; a divinyl compound such as divinyl aniline, divinyl ether, divinyl sulfide or divinyl sulfone; or a compound having three or more vinyl groups is singly or mixedly used.

Also, when a fixating device of the pressing fixation type is used, the binding resin of a toner for pressure fixation is usable, and mention may be made of, for example, polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyester, paraffin or the like.

It is preferable that the magnetic toner be used with a charging control agent added thereto, and the charging control agent can be contained in toner particles (internal addition) or the toner particles and the charging control agent can be mixed together (external addition).

As the positive charging control agent, a denatured substance by nigrosine and fatty acid metal salt or the like; fourth class ammonium salt such as tributyl benzyl ammonium-1-hydroxy-4-naphthosulfonic acid salt or tetrabutyl ammonium tetrafluoroborate; diorgano tin oxide such as dibutyl tin oxide, dioctyl tin oxide or dicyclohexyl tin oxide; or diorgano tin borate such as dibutyl tin borate, dioctyl tin borate or dicyclo tin borate can be used singly or in combination of two or more kinds. Among these, a charging control agent such as the nigrosine origin or fourth class ammonium salt can be particularly preferably used.

Also, a single polymer of a monomer represented by a general expression

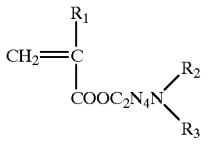

(where $R_1$ is H or $CH_3$; $R_2$ and $R_3$ are substituted or unsubstituted alkyl groups, and preferably are $C_1$ to $C_4$), or a copolymer of this monomer and a polymerizable monomer such as styrene, ester acrylate or ester methacrylate as previously mentioned can be used as the positive charging control agent. These charging control agents also have the action as part or the whole of binding resin.

As a negative charging control agent usable in the present invention, for example, organic metal complexes and chelate compounds are effective, and mention may be made of, for example, aluminum acetyl acetonate, iron (II) acetyl acetonate, 3, 5-ditertiary butyl chromium salicylate, etc. Particularly acetyl acetone metal complex, salicylic metal complex or salicylic metal salt is preferable, and above all, salicylic metal complex or metal salt is preferable.

The above-mentioned charging control agents (which do not have the action as binding resin) may preferably be used in the form of fine particles, and the number average particle diameter thereof may preferably be 4 μm or less, and particularly be 3 μm or less.

The amount of addition of the charging control agent internally added to the toner may preferably be 0.1 to 20 parts by weight to 100 parts by weight of binding resin, and more preferably be 0.2 to 10 parts by weight.

The amount of addition of the charging control agent externally added to the toner, in the case of fine powder silica, may preferably be 0.01 to 8 parts by weight to 100 parts by weight of toner, and more preferably be 0.1 to 5 parts by weight. This silica intervenes between toner particles and the surface of the developing sleeve, whereby it also has the action of remarkably mitigating the abrasion of the developing sleeve.

It is preferable to add the fine powder of a fluorine containing polymer, for example, the fine powder of polytetra-fluoroethylene, polyvinylidene fluoride or the like, or the fine powder of tetrafluoroethylene-vinylidene fluoride copolymer as an externally added agent to the toner. Particularly the fine powder of polyvinylidene fluoride is preferable in improving the fluidity and polishing property of the toner. The amount of addition of the fine powder of fluorine containing polymer to the toner may preferably be 0.01 to 2.0 wt % by weight, and particularly preferably be 0.02 to 1.0 wt % by weight.

Particularly, when a combination of the fine powder of silica and the fine powder of fluorine containing polymer is added, although the reason is not clear, the state of presence of silica adhering to the magnetic toner is stabilized and the possibility of silica which has adhered freeing from the toner to thereby wear the toner or contaminate the developing sleeve can be reduced, and the stability of the charging of the toner can be further increased.

As a polishing agent for the photosensitive drum, strontium titanate is sometimes added to the toner. This polishing agent has the action of preventing the adherence of the toner to the surface of the photosensitive drum, and the amount of addition thereof to the toner is preferably 0.01 to 1.0 wt % by weight.

The magnetic toner may serve also as a black colorant, and contains magnetic materials. As the magnetic materials contained in the magnetic toner, mention may be made of iron oxide such as magnetite, γ-iron oxide, ferrite or iron excessive type ferrite; a metal such as iron, cobalt or nickel, or alloys of these metals and a metal such as aluminum, cobalt, copper, lead, magnesium, tin, zinc, antimony, beryllium, bismnth, cadmium, calcium, manganese, selenium, titanium tungsten or vanadium, and mixtures thereof. These are all ferromagnetic materials.

The average grain diameter of these magnetic materials may be 0.1 to 1.0 μm, and preferably 0.1 to 0.5 μm. The content of the magnetic materials in the magnetic toner is 60 to 110 parts by weight to 100 parts by weight of resin in the toner, and preferably 65 to 100 parts by weight to 100 parts by weight of resin.

Some experimental examples of image formation in the present embodiment will hereinafter be described.

EXPERIMENTAL EXAMPLE 1

In accordance with the present embodiment, the surface of an aluminum sleeve was roughened by the blast treatment by glass beads, whereafter it was subjected to electroless Ni—P plating (work function=4.4 eV) to thereby obtain a developing sleeve having a plating thickness of 6 μm and surface roughness Ra of 1.1 μm. This was incorporated as the developing sleeve 6 of FIG. 1 into the developing device 3 and was used for development, and image formation was effected.

An a-Si drum was used as the photosensitive drum 1, and the gap between the photosensitive drum and the developing sleeve was 230 μm. The photosensitive drum was charged to surface potential +400 V and image exposure was effected to thereby form a latent image to surface potential +50 V, and the latent image was developed by the use of the aforementioned toner A (work function=4.1 eV) of positive chargeability. A developing bias comprising a DC voltage of +250 V, a peak-to-peak voltage Vpp=1.47 kV and an AC voltage of a frequency f=2.75 kHz superposed one upon another was applied to the developing sleeve.

As the result, a sufficient amount of conveyed toner of 0.8 mg/cm$^2$ and a sufficient charged amount of 11.1 $\mu$C/g were obtained in the toner on the developing sleeve, and even when 3,000,000 sheets of print having a printing rate 6% at A4 size was effected, a reduction in density and deterioration of images were hardly seen.

EXPERIMENTAL EXAMPLE 2

In accordance with the present embodiment, the surface of a stainless sleeve was roughened by glass beads blast treatment, and was subjected to electroless Ni—B plating (work function=4.5 eV) to thereby obtain a developing sleeve having a plating thickness of 6 $\mu$m and surface roughness Ra=1.1 $\mu$m, and this developing sleeve was likewise incorporated into the developing device 3 of FIG. 1 and was used for development, and image formation was effected.

An OPC drum was used as the photo-sensitive drum 1, and the gap between the photosensitive drum and the developing sleeve was 250 $\mu$m. The surface potential on the photosensitive drum was −600 V, and development was effected by the use of the aforementioned toner A (work function=4.1 eV). A developing bias comprising a DC voltage of −450 V, a peak-to-peak voltage Vpp=1.2 kV and an AC voltage of a frequency f=2.2 kHz superposed one upon another was applied to the developing sleeve.

As the result, a sufficient amount of conveyed toner of 0.78 mg/cm$_2$ and a charged amount of 10.5 $\mu$C/g were obtained in the toner on the developing sleeve. Also, as compared with a case where a developing sleeve not subjected to electroless Ni—B plating was used, a reduction in density and deterioration of images were hardly seen even at a point of time whereat 5,000,000 sheets of print about five times as many as in said case was effected.

Embodiment 2

Figure 5:
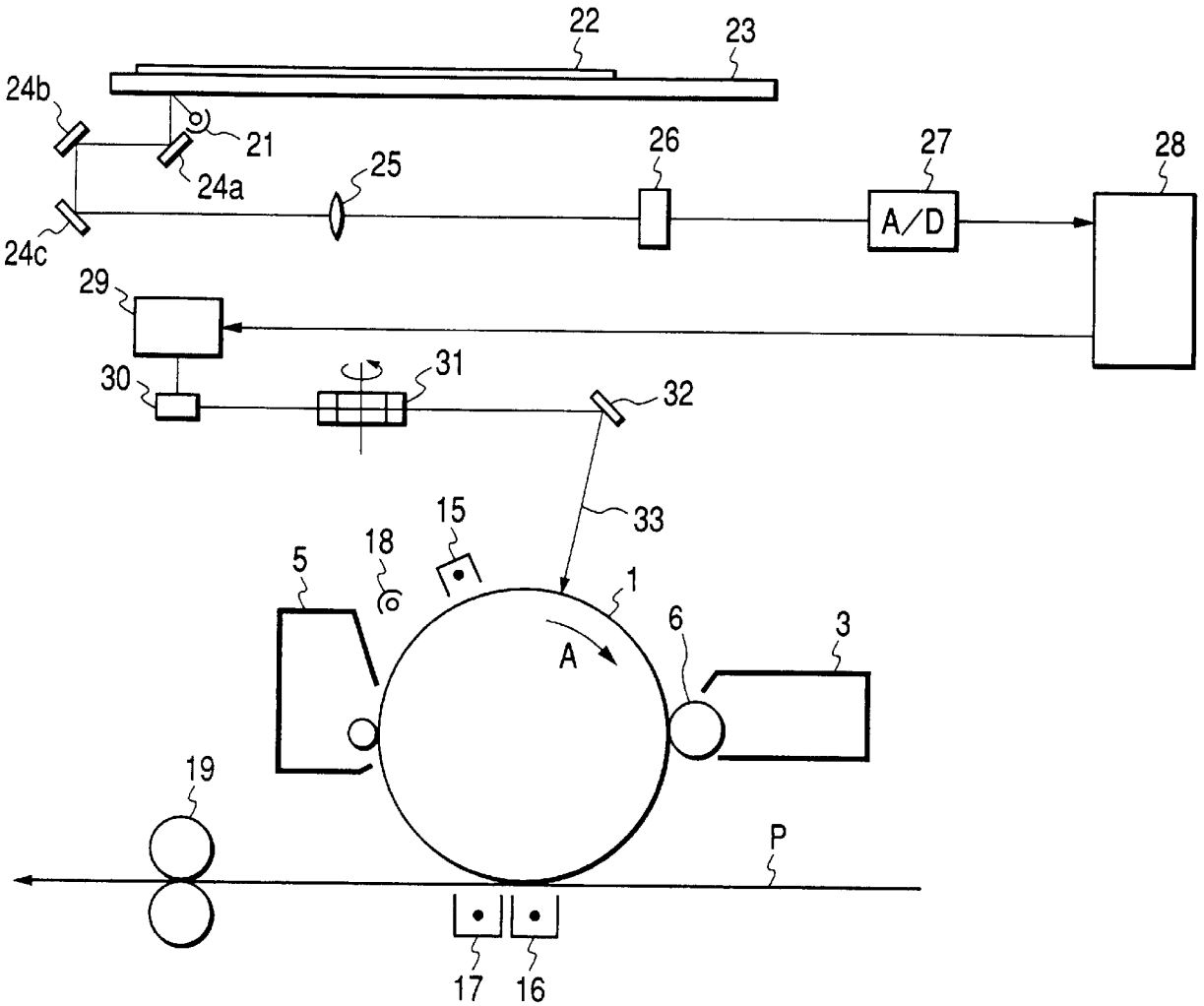
FIG. 5 schematically shows the construction of another embodiment of the present invention.

FIG. 5 schematically shows the general construction of another embodiment of the image forming apparatus of the present invention, and this apparatus is a digital copying apparatus.

A photosensitive drum 1 is provided with a photoconductive layer of amorphous silicon on a cylindrical electrically conductive base, and is journalled for rotation in the direction of arrow R1. Around this photosensitive drum 1 and along the direction of rotation thereof, there are disposed a scotron charger 15 for uniformly charging the surface of the photosensitive drum 1, an exposure device including an exposure lamp 21 and an image scanner 26 for reading an original 22 placed on a glass table 23 above the photosensitive drum 1, and effecting image exposure 33 on the photosensitive drum 1 on the basis of an image signal proportional to the density of a color-resolved image, a developing device 3 for developing an electrostatic latent image formed by the image exposure by the use of a toner charged to the positive, a corona charger 16 for transferring a toner image formed on the photosensitive drum by the development of the latent image onto a transfer material P supplied to the photosensitive drum 1, an electrostatic separating charger 17 for separating the transfer material P having the toner image transferred thereto from the photosensitive drum 1, a cleaning device 5 for cleaning the surface of the photosensitive drum 1 after the toner image has been transferred and removing any untransferred toner, and a pre-exposure device (lamp) 18 for removing any residual charge on the surface of the photosensitive drum 1.

The transfer material P separated from the photosensitive drum 1 is conveyed to a fixating device 19, where it is heated and pressed, whereby the transferred toner is fixated on the image transfer material P and is formed into a desired print image, whereafter the transfer material P is discharged out of the image forming apparatus.

The exposure lamp 21 of the exposure device reads the original 22 on the glass table 23 while being moved along the glass table 23, and the image information thus obtained is inserted into the image scanner 26 via reflecting mirrors 24*a*, 24*b* and 24*c* moved with the exposure lamp 21 and further a short focus lens 25.

The image scanner 26 converts the image information into an electrical signal, and this electrical signal is digitized by an A/D converter 29, and thereafter is sent to a signal processing portion 28, where it is converted into a digital image signal of 256 harmonies proportional to the image density.

This image signal is sent to a laser driver 29 as a driving signal generating portion, and is used to generate a driving signal for a laser 30 by the laser driver 29 so as to modulate the light transmission of the laser 30 by the driving signal in conformity with the image signal. The laser beam modulated in conformity with the image signal is applied as image exposure 33 to the photosensitive drum 1 via a polygon mirror 31 and a reflecting mirror 32, whereby an electrostatic latent image conforming to the image signal is formed on the photosensitive drum 1. The copying speed of the digital copying apparatus of the present embodiment is 60 to 100 sheets per minute for A4 size.

In the present embodiment, image formation was effected. First, the photosensitive drum 1 was charged to +400 V by the charger 15, and the image exposure 33 based on the image signal was effected, and the surface potential of the exposure portion was attenuated to e.g. maximum +50 V, and a latent image was formed. Then, for example, a DC voltage of +250 V, or a voltage comprising an AC voltage of a rectangular wave superposed thereon of which the peak-to-peak voltage Vpp was 1.4 kV and the frequency f was 2.7 kHz was applied as a developing bias to the developing sleeve 6 of the developing device 3, and by the use of a black toner which was a magnetic toner as a one-component developer, the latent image was developed by a reverse developing system.

The developing sleeve 6 is an aluminum sleeve of which the surface was blast-treated into a rough surface by glass beads of a regular shape, and then was subjected to electroless Ni—P plating to thereby provide surface roughness Ra 1.1 $\mu$m, a plating thickness of 6 $\mu$m and hardness Hv of about 500. In the other points, the construction of the developing device 3 is the same as that of the developing device 3 described in connection with FIG. 1. The aforementioned toner A was used as the magnetic toner.

In this case, the amount of conveyed toner on the developing sleeve was 0.8 mg/cm$^2$ and the charged amount of toner was 10.5 $\mu$C/g, and from the initial stage, sufficient image density and image quality were obtained. At the point of time of 1,000,000 sheets of A4 size print, the amount of scraped plating on the surface of the developing sleeve was of the order of 1.0 $\mu$m, and the resin or the like of the toner was not embedded in the surface of the developing sleeve, and sufficient density and image quality could be maintained.

Embodiment 3

Figure 6:
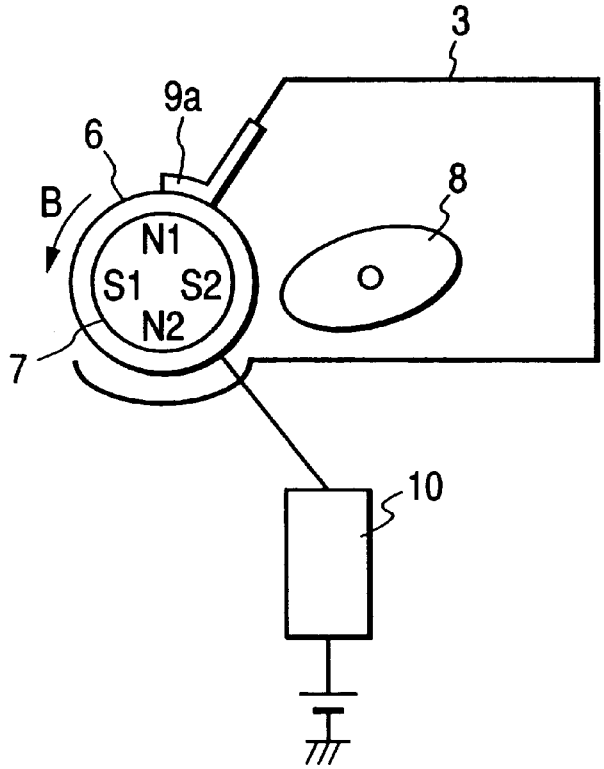
FIG. 6 schematically shows the construction of a developing device in still another embodiment of the present invention.
Figure 7:
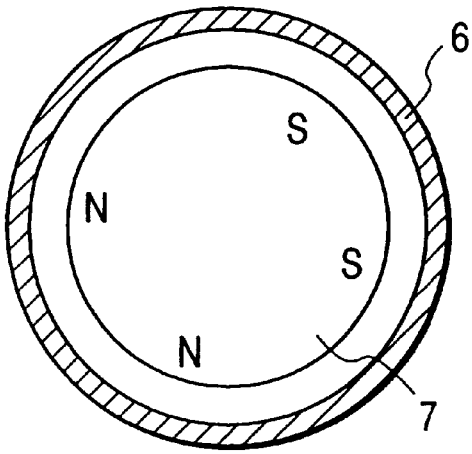
FIG. 7 is a cross-sectional view showing an example of the developing sleeve of the developing device of an image forming apparatus.
Figure 8:
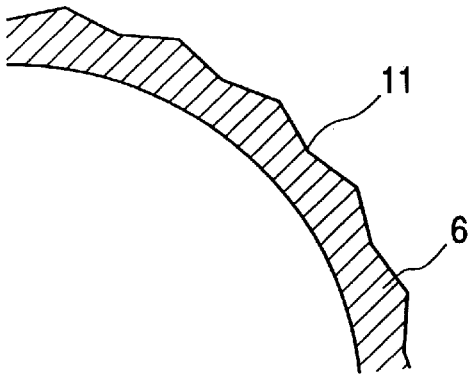
FIG. 8 is a cross-sectional view showing the surface portion of the developing sleeve of FIG. 7.
Figure 9:
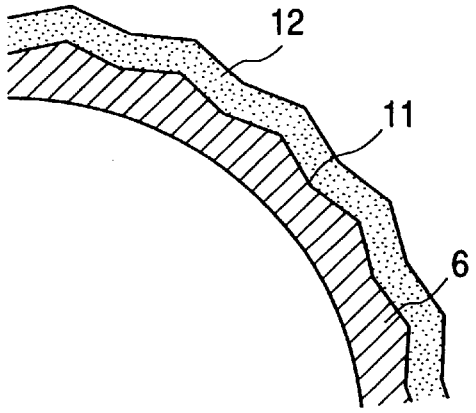
FIG. 9 is a cross-sectional view showing a metal layer provided on the surface portion of the developing sleeve.

In this embodiment, as shown in FIG. 6, an elastic blade 9*a* instead of a magnetic blade was used as the developer regulating member of the developing device 3, and this was brought into direct contact with the developing sleeve 6. Also, as the developing sleeve 6, a stainless sleeve was surface-roughened by blast treatment of glass beads, whereafter it was subjected to electroless Pd—P plating (work function=4.5 eV) to thereby make a developing sleeve having surface roughness Ra of 1.1 μm, a plating thickness of 6 μm and hardness Hv of 470, and this was used.

The mechanical construction of the image forming apparatus itself of the present embodiment is basically the same as that of Embodiment 1 of FIG. 1.

An OPC drum was used as the photosensitive drum 1, and the gap between the photosensitive drum and the developing sleeve was 250 μm. The surface of the photosensitive drum was charged to −600 V, and image exposure was effected to thereby form a latent image at −100 V, and the latent image was developed by the use of the aforementioned toner A (work function=4.1 eV). A developing bias comprising a DC voltage (−450 V) and an AC voltage (Vpp=1.2 kV, f=2.2 kHz) superposed one upon another was applied to the developing sleeve, and image formation was effected.

As the result, a proper amount of conveyed toner of 0.78 g/cm$^2$ and a charged amount of 10.5 μC/g were obtained in the toner on the developing sleeve, and from the initial stage of image formation, sufficient density and image quality could be obtained.

In the present embodiment, use is made of the elastic blade directly contacting with the developing sleeve and therefore, the scraping or the like of the surface of the developing sleeve by the long-term use thereof is feared, but electroless Pd—P plating has high hardness Hv of 470 as described above and therefore, there is no problem, and at the point of time of 1,000,000 sheets of A4 size print, the amount of scraping was 2.5 μm, and sufficient density and image quality could be maintained even after long-term use. While the present embodiment has been described by the use of the magnetic toner, the present invention is also effective for a non-magnetic toner because the feature of the present invention prescribes the charging characteristics of the toner and the plating layer on the surface of the developing sleeve, and the present invention is applicable to a non-magnetic one-component developing method using a developing sleeve having no magnet roller inside.

While in the present embodiment, the elastic blade 9*a* is used as the developer regulating member, use may be used of a roller made of a single-foamed elastic material, and this is likewise used in contact with the developing sleeve, and the present invention is also effective when such a regulating roller made of a single-foamed elastic material is used.

While in the aforedescribed embodiment, attention has been paid to the difference between the work functions of the surface layer of the developing sleeve and the toner, the inventors have further found that there is also a relation between the difference in the work function and the surface roughness of the developing sleeve.

Figure 12:
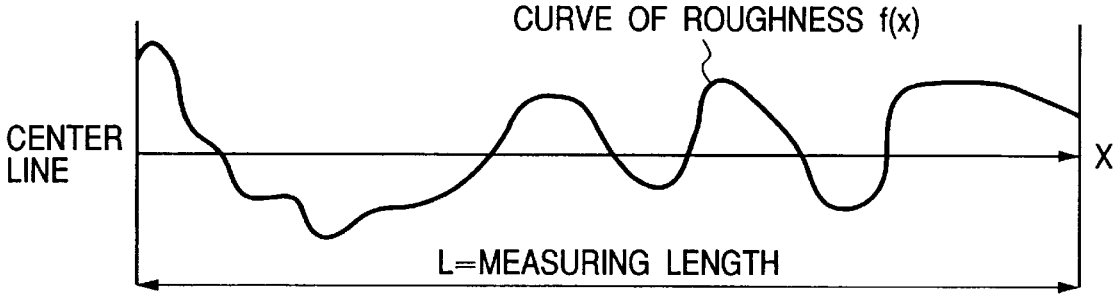
FIG. 12 is a graph for illustrating a method of measuring the surface roughness Ra.

FIG. 12 shows a method of measuring the surface roughness Ra.

Figure 11:
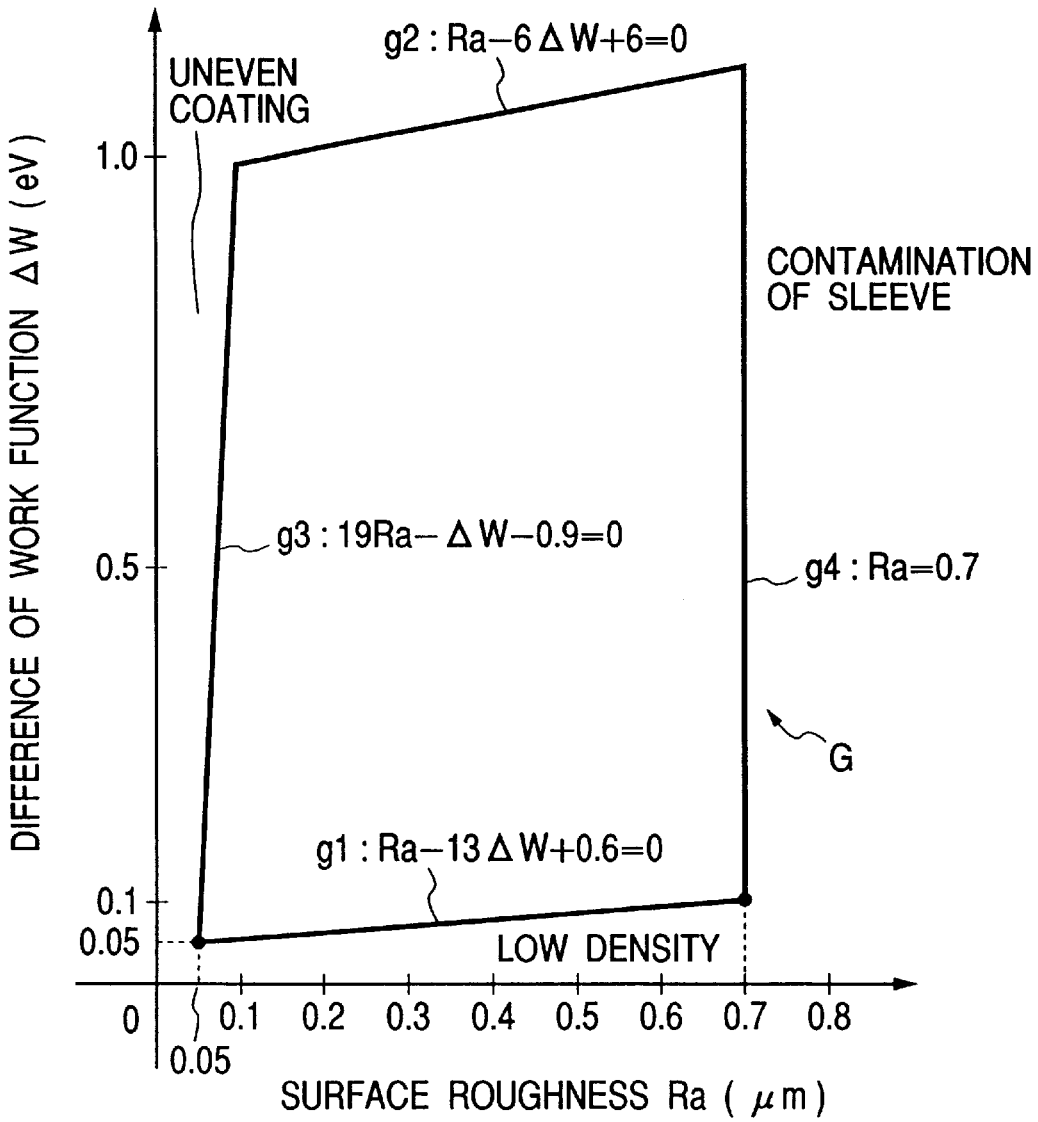
FIG. 11 is a graph showing the relation between the difference of work function ΔW and the surface roughness Ra.

Here, Ra refers to the center line average roughness, and as shown in FIG. 11, it is a value obtained by pulling out a portion of a measured length L from a roughness curve f(X) in the direction of the center line thereof, and arithmetically averaging the absolute value of the deviation between the center line of the pulled-out portion and the roughness curve.

Description will now be made of an embodiment prescribing the surface roughness and work function of the developing sleeve.

Embodiment 4

In this embodiment, the surface roughness (center line average roughness) Ra of the surface of the developing sleeve 6 is 0.7 μm or less. The lower limit of Ra is 0.05, but specifically, it is determined by the relation of the difference between the work functions of the nonmetal plating layer provided on the surface of the developing sleeve and the magnetic toner used. Description will hereinafter be made on the basis of an experiment carried out by the inventors.

A developing sleeve of stainless steel (SUS316) had its surface sand-blast-treated by glass beads of #300 and was used for development, and continuous image formation was repetitively effected by the use of a toner of a small grain diameter (6 μm) which can be improved in its image developing property. The following phenomena happened. (1) When the number of printed sheets reached 2000 to 5000, image density lowered from 1.3 to 1.0. (2) When at a point of time whereat the image density lowered, image formation was done with the original changed to a solid black one, the printed image became a partly white image having a low density portion corresponding to the rotation period of the developing sleeve. (3) When the toner on the developing sleeve at the point of time whereat the image density lowered was removed and the developing sleeve was washed by a solvent and then was again used for development, the image density was recovered.

So, when the amount of frictional charging of the toner at the point of time of item (1) above whereat the image density lowered was measured, it was ½ or less of the charged amount of toner at the start of image formation, and it has been found that the reduction in the charged amount of toner is the cause of the lowering of the image density. Likewise, when the creation of the partly white image of item (2) above was examined, the white portion was also caused by the reduction in the charged amount of toner. However, it is inferred that the recovery of the image density by the removal of the toner and the washing of the developing sleeve mentioned under item (3) above was caused not by the deterioration of the toner including the lowering of the charged amount, but by a change in the properties of the surface of the developing sleeve.

In order to confirm a change in the properties of the surface of the developing sleeve, the surface of the developing sleeve was observed by means of an electronic microscope at the above-mentioned point of time whereat the image density lowered. Thereupon, as typically shown in FIG. 3, it has been found that in particularly the recess 13 of the uneven portion of the surface, more specifically the recess 13 having a diameter of the order of 40 μm and a depth of the order of 1 μm, there are a plurality of small depressions 14 having a diameter of the order of 5 μm, and the debrises of the resin which is the main component of the toner are embedded in these depressions 14.

When the debri of the resin of the toner are thus embedded in the surface of the developing sleeve, the resin of the toner contacting with the surface of the developing sleeve often contacts with the resin on the surface of the developing sleeve and therefore, sufficient frictional charging charges are not given to the toner and the charged amount of toner is reduced. The phenomenon of the debri of the resin of the toner being embedded in the surface of the developing sleeve will hereinafter be referred to as "sleeve contamination".

So, when the surface of the developing sleeve was blast-treated with the condition changed and was made into a smoother surface of surface roughness Ra of 0.7 μm and the developing sleeve was used for development to thereby effect continuous image formation, the sleeve contamination was hardly seen. Considering from this, to make Ra great, the air pressure used for the flowing of abrasive grains must be made strong, and along therewith, the small depressions having a diameter of the order of 5 μm produced in the surface of the developing sleeve are increased and therefore, it seems that when Ra is 0.7 μm or greater, the sleeve contamination occurs.

In the present embodiment, a plurality of developing sleeves having surface roughness Ra of 0.1 to 0.9 μm were prepared and each of them was used for development to thereby effect continuous image formation of 5,000 sheets, and the sleeve contamination was examined. The result is shown in Table 5 below.

In Table 5, as regards the marks in the columns of sleeve contamination, ○ means that the amount of charge of the toner on the developing sleeve has about 80% or more of the amount at the initial stage, at the end of image formation, Δ means that it has not less than 60% and less than 80%, and x means that it has only less than 60%.

Generally, if continuous image formation of 5,000 sheets is effected and at the end of the image formation, the amount of charge of the toner on the developing sleeve has about 80% of the initial amount of charge, even if the developing sleeve is used for a long period thereafter, it does not happen that the amount of charge of the toner decreases greatly, and it seems that there is no problem in the long-term use of the developing sleeve, and it becomes a standard.

TABLE 5

| Ra (μm) | 0.1 | 0.3 | 0.5 | 0.7 | 0.8 | 0.9 |
|---|---|---|---|---|---|---|
| sleeve contamination | ○ | ○ | ○ | Δ | x | x |

As shown in Table 5, to prevent the sleeve contamination during continuous image formation and stably maintain image density, it is seen that the surface roughness Ra of the developing sleeve should preferably be 0.7 μm or less. However, for the surface roughness within such a range, the fluctuation of the amount of charge of the toner is not great, but instead there arises the problem that the conveyability of the toner on the developing sleeve is not sufficiently obtained and appropriate image density cannot be secured from the viewpoint of the amount of toner.

In the present embodiment, blast treatment was effected on a developing sleeve made of aluminum containing a magnet roller therein by the use of glass beads of #300 to thereby roughen the surface of the developing sleeve. At this time, the air pressure under which the glass beads were blown was changed to several levels to thereby variously change the surface roughness Ra of the developing sleeve. These developing sleeves were used in the developing device 3 of FIG. 1 and the conveying property thereof for the magnetic toner of positive charge ability contained in the developing device 3 was examined. The result is shown in FIG. 10.

Figure 10:
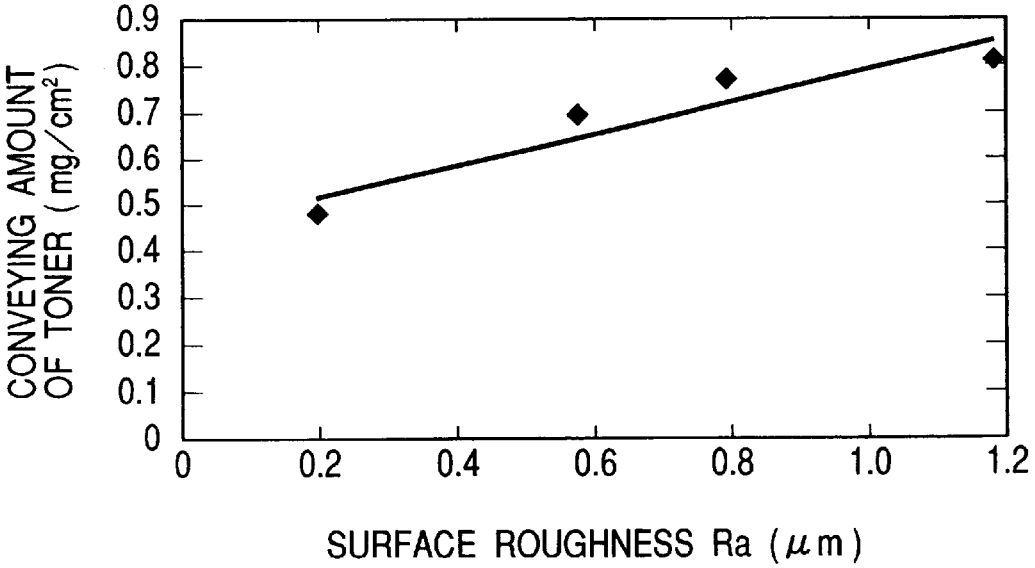
FIG. 10 is a graph showing the relation between the surface roughness and the amount of conveyed toner.

As shown in FIG. 10, the toner conveying property of the developing sleeve is substantially determined by the degree of the surface roughness, and the greater becomes the surface roughness, the greater becomes the conveyed amount. In the present invention, nonmagnetic metal plating is provided on the roughened surface of the developing sleeve, but if the thickness of this plating is small and uniform, the surface roughness of the developing sleeve does not substantially change and the toner conveying property is not affected.

Generally it is known that when the amount of toner per unit area on the photosensitive drum is 0.5 mg/cm$^2$ or greater, sufficient density is obtained as a printed image. So, assuming that the amount of toner coating per unit area on the developing sleeve is a (mg/cm$^2$) and the ratio (peripheral velocity ratio) of the rotational velocity of the developing sleeve to that of the photosensitive drum is b (no unit) and the toner of maximum 50% of the toner on the developing sleeve was used for development, when the condition that $0.5 \leqq a \cdot b \cdot 0.5$, and accordingly $1.0 \leqq a \cdot b$ is satisfied, a printed image of sufficient density is obtained.

Table 6 below shows the result of the examination of the density of printed images when developing sleeves of various surface roughnesses were used with the amount of toner coating a and the peripheral velocity ratio changed variously. In Table 6, the mark ○ shows that the initial density (the maximum density at the initial stage of development) is 1.3 or greater, the mark Δ shows that the initial density is not less than 1.2 and less than 1.3, and the mark x shows that the initial density is less than 1.2.

TABLE 6

| | surface roughness Ra (μm) | | | | | | | | |
|---|---|---|---|---|---|---|---|---|---|
| | 0.05 | 0.1 | 0.2 | 0.3 | 0.4 | 0.5 | 0.6 | 0.7 | 0.8 |
| amount of toner coating a (mg/cm$^2$) | 0.45 | 0.48 | 0.48 | 0.56 | 0.59 | 0.63 | 0.66 | 0.70 | 0.75 |
| a × b (peripheral velocity ratio b = 1.2) | 0.54 | 0.58 | 0.58 | 0.67 | 0.71 | 0.79 | 0.80 | 0.84 | 0.9 |
| initial density | x | x | x | x | x | x | x | x | Δ |
| a × b (peripheral velocity ratio b = 1.5) | 0.68 | 0.72 | 0.72 | 0.84 | 0.89 | 0.95 | 0.99 | 1.05 | 1.13 |
| initial density | x | x | x | x | x | Δ | 0 | 0 | 0 |
| a × b (peripheral velocity ratio b = 1.8) | 0.81 | 0.86 | 0.86 | 1.01 | 1.06 | 1.13 | 1.19 | 1.26 | 1.35 |
| initial density | x | x | x | 0 | 0 | 0 | 0 | 0 | 0 |
| a × b (peripheral velocity ratio b = 2.1) | 0.95 | 1.0 | 1.0 | 1.18 | 1.24 | 1.32 | 1.39 | 1.47 | 1.58 |
| initial density | Δ | 0 | 0 | 0 | 0 | 0 | 0 | 0 | 0 |

Here, developing sleeves of which the surface roughness Ra is greater than 0.7 can secure a proper value as the initial image density, but in the case of any peripheral velocity ratio, as previously described, sleeve contamination occurs and the reduction in density is remarkable and therefore, such developing sleeves are not appropriate developing sleeves. Also, in developing sleeves of surface roughness of 0.05>Ra (e.g. Ra=0.03 μm), in the case of any peripheral velocity ratio, the charged amount of toner exceeds 15 μC/g and the developing sleeve is not uniformly coated with the toner and therefore, irregularity occurs to images and thus, such developing sleeves are neither appropriate developing sleeves.

We further carried out an experiment when the surface roughness Ra of the developing sleeve was lowered to Ra=0.5, 0.3, 0.1, 0.05. The peripheral velocity ratio of the developing sleeve was set to a proper value obtained from the previous experiment. As the result, it was confirmed that when the surface roughness Ra of the developing sleeve and the difference ΔW between the work functions of the plating layer of the developing sleeve and the toner are combined so as to be within a quadrilateral area G shown in FIG. 11, sufficient image density is obtained and there is no uneven coating of the toner on the developing sleeve.

The quadrilateral area G in FIG. 11 is such that the difference ΔW in work function is surrounded by two upper and lower leftwardly downwardly inclined straight lines g2 and g1 with respect to the surface roughness Ra of the developing sleeve. This means that if the surface roughness Ra of the developing sleeve is made smaller (reduced), the effective friction area of the surface of the developing sleeve with the toner increases and therefore the charged amount of the toner becomes greater and thus, to prevent the uneven coating of the toner from occurring, the difference ΔW in work function ("the work function of the plating layer"−"the work function of the toner") must be made smaller.

The four upper, lower, left and right straight lines g2, g1, g3 and g4 defining the quadrilateral area G can be represented by the following expressions:

g1: $Ra-13\Delta W+0.6=0$ g2: $Ra-6\Delta W+6=0$ g3: $19Ra-\Delta W-0.9=0$ g4: $Ra=0.7$ Accordingly, the quadrilateral area G is represented by the following four inequalities:

$Ra-13\Delta W+0.6\leqq 0$ $Ra-6\Delta W+6\geqq 0$ $19Ra-\Delta W-0.9\geqq 0$ $Ra\leqq 0.7$ The units are μm for Ra, and eV for ΔW.

The foregoing, is a case where the charging of the toner is of the positive polarity, but when the charging of the toner is of the negative polarity, ΔW can be replaced with −ΔW and the following can be done:

$Ra+13\Delta W+0.6\leqq 0$ $Ra+6\Delta W+6\geqq 0$ $19Ra+\Delta W-0.9\geqq 0$ $Ra\leqq 0.7$ If the polarity of charging is generalized so as to be applicable to a positive toner and a negative toner, by the use of the absolute value of the difference in work function, $Ra-13|\Delta W|+0.6\leqq 0$ $Ra-6|\Delta W|+6\geqq 0$ $19Ra-|\Delta W|-0.9\geqq 0$ $Ra\leqq 0.7$ An experimental example of image formation in the present embodiment will hereinafter be described.

EXPERIMENTAL EXAMPLE 1

In accordance with the present embodiment, the surface of an aluminum sleeve was roughened by blast treatment by glass beads, and thereafter was subjected to electroless Ni—P plating (work function=4.4 eV) to thereby obtain a developing sleeve having a plating thickness of 6 μm and surface roughness Ra of 1.1 μm. This was incorporated as the developing sleeve 6 of FIG. 1 into the developing device 3 and was used for development, and image formation was effected.

An a-Si drum was used as the photo-sensitive drum 1, and the gap between the photosensitive drum and the developing sleeve was 230 μm. The photosensitive drum was charged to surface potential of +400 V and image exposure was effected to thereby form a latent image at surface potential of +50 V, and the latent image was developed by the use of the aforementioned toner A (work function=4.1 eV) of positive chargeability. The peripheral velocity ratio b of the developing sleeve was 2.1. A developing bias comprising a DC voltage of +250 V and an AC voltage having a peak-to-peak voltage Vpp=1.4 kV and a frequency f=2.7 kHz superposed one upon the other was applied to the developing sleeve.

Embodiment 5

This embodiment was applied to the digital copying apparatus of FIG. 5.

The copying speed of the digital copying apparatus of the present embodiment is 60 to 100 sheets per minute for A4 size.

In the present embodiment, image formation was effected. First, the photosensitive drum 1 was charged to +400 V by the charger 15, image exposure 33 based on an image signal was effected to thereby attenuate the surface potential of the exposure portion to e.g. maximum +50 V, and form a latent image. Then, as a developing bias, e.g. a DC voltage of +250 V or a voltage comprising an AC voltage of rectangular wave having a peak-to-peak voltage Vpp of 1.4 kV and a frequency f=2.7 kHz superposed thereon was applied to the developing sleeve 6 of the developing device 3, and by the use of a black toner which was a magnetic toner as a one-component developer, the latent image was developed by a reverse developing system.

The developing sleeve 6 is one obtained by blast-treating the surface of an aluminum sleeve with glass beads of a regular shape to thereby roughen the surface, and then subjecting the surface of the aluminum sleeve to electroless Ni—P plating to thereby provide surface roughness Ra=0.5 μm, a plating thickness of 6 μm and hardness Hv of about 500. In the other points, the construction of the developing device 3 is the same as that of the developing device 3 described in connection with FIG. 1. The aforementioned toner A was used as the magnetic toner. The peripheral velocity ratio b of the developing sleeve was 1.6.

In this case, the amount of conveyed toner on the developing sleeve was 0.65 mg/cm$^2$ and the charged amount of toner was 10.5 μC/g, and sufficient image density and image quality were obtained from the initial stage. At a point of time whereat 1,000,000 sheets of A4 size were printed, the scraped amount of plating on the surface of the developing sleeve was of the order of 1.0 μm, and no resin of the toner was embedded in the surface of the developing sleeve, and sufficient density and image quality could be maintained.

Embodiment 6

In this embodiment, as shown in FIG. 6, an elastic blade 9*a* instead of a magnetic blade is used as the developer regulating member of the developing device 3, and this is brought into direct contact with the developing sleeve 6.

Also, as the developing sleeve 6, a stainless sleeve was surface-roughened by blast treatment of glass beads, whereafter it was subjected to electroless Pd—P plating (work function=4.5 eV) to thereby make a developing sleeve having surface roughness Ra of 0.7 μm, a plating thickness of 6 μm and hardness Hv of 470, and this sleeve was used.

The mechanical construction of the image forming apparatus itself of the present embodiment is basically the same as that of Embodiment 1 of FIG. 1.

An OPC drum was used as the photosensitive drum 1, and the gap between the photosensitive drum and the developing sleeve was 250 μm. The surface of the photosensitive drum was charged to −600 V, and image exposure was effected to thereby form a latent image at surface potential of −100 V, and this latent image was developed by the use of the aforementioned toner A (work function=4.1 eV). A developing bias comprising a DC voltage (−450 V) and an AC voltage (Vpp=1.2 kV and f=2.2 kHz) superposed one upon the other was applied to the developing sleeve, and image formation was effected.

As the result, in the toner on the developing sleeve, there were obtained a proper amount of conveyed toner of 0.70 g/cm$^2$ and a charged amount of 10.5 μC/g, and from the initial stage of image formation, sufficient density and image quality could be obtained.

In the present embodiment, use is made of an elastic blade directly contacting with the developing sleeve and therefore, the scraping or the like of the surface of the developing sleeve by the long-term use thereof is feared, but there is no problem because the electroless Pd—P plating has high hardness Hv of 470 as described above, and the amount of scrape was 2.5 μm at a point of time whereat 1,000,000 sheets of A4 size were printed, and sufficient density and image quality could be maintained still after long-term use. While the present invention has been described by the use of the magnetic toner, the feature of the present invention is to prescribe the charging characteristic of the plating layer on the surface of the developing sleeve and therefore, the present invention is also effective for a non-magnetic toner, and is applicable to a non-magnetic one-component developing method using a developing sleeve having no magnet roller inside.

In the present embodiment, the elastic blade 9*a* is used as the developer regulating member, but use may be made of a roller made of a single-foamed elastic material, and this is likewise used in contact with the developing sleeve, and the present invention is also effective when use is made of a regulating roller made of such a single-foamed elastic material.

While the embodiments of the present invention has been described above, the present invention is not restricted to these embodiments, but all modifications are possible within the technical idea of the present invention.

What is claimed is:

1. A developing device comprising:

a developing container containing a toner therein; and a toner bearing member provided in an opening portion of said developing container for bearing the toner and being rotatable with the toner borne thereon;

said toner bearing member satisfying the following conditions:

$Ra-13|\Delta W|\leqq -0.6$ $Ra-6|\Delta W|\geqq -6$

19$Ra-|\Delta W|\geqq 0.9$ $Ra\leqq 0.7$ where Ra is center line average roughness (μm) of the surface of said toner bearing member, and ΔW is difference (eV) between a work function of the surface of the toner bearing member and a work function of the toner.

2. A developing device according to claim 1, wherein said toner bearing member is provided in an opposed relationship with an image bearing member bearing an electrostatic image thereon, such that when an amount of coating of the toner per unit area of said toner bearing member is a (mg/cm$^2$) and a ratio of a peripheral velocity of said toner bearing member to said image bearing member is b, said toner bearing member satisfies the following condition:

$a\times b\geqq 1.0$.

3. A developing device according to claim 1, wherein said toner bearing member is made from a non-magnetic metal base material with a plating layer provided on the base material.

4. A developing device according to claim 3, wherein a thickness of the plating layer is between 3 μm and 20 μm.

5. A developing device according to claim 3, wherein a Vickers hardness, Hv, of the plating layer is not less than 450 and not more than 1000.

6. A developing device according to claim 5, wherein the base material is aluminum.

7. A developing device according to claim 3, wherein the plating layer is subjected to a surface roughening treatment, resulting in a surface roughness, Ra, thereof between 0.6 μm and 14μm.

8. A developing device according to claim 1, wherein a charging polarity of the toner is positive, and a work function of the surface of said toner bearing member is greater than a work function of the toner.

9. A developing device according to claim 1, wherein a charging polarity of the toner is negative, and a work function of the surface of said toner bearing member is less than a work function of the toner.

* * * * *

UNITED STATES PATENT AND TRADEMARK OFFICE

CERTIFICATE OF CORRECTION

PATENT NO. : 6,104,903

DATED : August 15, 2000

INVENTOR(S) : NOBUAKI HARA, ET AL.

It is certified that error appears in the above-identified patent and that said Letters Patent is hereby corrected as shown below:

COLUMN 2:
Line 48, "Further," should read --Further--.

COLUMN 4:
Line 37, "an" should read --on--;
Line 43, "sleeve:" should read --sleeve):--.

COLUMN 5:
Line 9, "photo-sensitive" should read --photosensitive--;
Line 64, "of" should be deleted.

COLUMN 6:
Line 15, "was" should read --were--;
Line 59, close up right margin;
Line 60, close up left margin.

COLUMN 7:
Line 5, "B" should read --8--.

UNITED STATES PATENT AND TRADEMARK OFFICE

CERTIFICATE OF CORRECTION

PATENT NO. : 6,104,903

DATED : August 15, 2000

INVENTOR(S) : NOBUAKI HARA, ET AL.

It is certified that error appears in the above-identified patent and that said Letters Patent is hereby corrected as shown below:

COLUMN 8:
Line 28, "debri" should read --debris--;
Line 40, "the eliminating" should read --eliminating--;
Line 55, "usually" should read --the usually--.

COLUMN 9:
Line 65, "b" should read --B--.

COLUMN 11:
Line 67, "magnetization or" should read --magnetization or--.

COLUMN 12:
Line 24, "fran" should read --furan--;
Line 56, "acrynitrile" should read --acrylonitrile--;
Line 66, "dinyl" should read --divinyl.

COLUMN 14:
Line 37, "bismnth," should read --bismuth,--;
Line 38, "titanium" should read --titanium,--.

UNITED STATES PATENT AND TRADEMARK OFFICE

CERTIFICATE OF CORRECTION

PATENT NO. : 6,104,903

DATED : August 15, 2000

INVENTOR(S) : NOBUAKI HARA, ET AL.

It is certified that error appears in the above-identified patent and that said Letters Patent is hereby corrected as shown below:

COLUMN 15:
Line 30, "0.78 mg/$cm_2$" should read --0.78 mg/$cm^2$--.

COLUMN 16:
Line 12, close up right margin;
Line 14, close up left margin.

COLUMN 18:
Line 56, "debrises" should read --debris--;
Line 58, "debri" should read --debris--;
Line 64, "debri" should read --debris--.

COLUMN 21:
Line 50, "foregoing," should read --foregoing--.

UNITED STATES PATENT AND TRADEMARK OFFICE

CERTIFICATE OF CORRECTION

PATENT NO. : 6,104,903

DATED : August 15, 2000

INVENTOR(S) : NOBUAKI HARA, ET AL.

It is certified that error appears in the above-identified patent and that said Letters Patent is hereby corrected as shown below:

COLUMN 22:
Line 11, "photo-sensitive" should read --photosensitive--.

COLUMN 23:
Line 48, "has" should read --have--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*